US009347632B2

(12) United States Patent
Adkins

(10) Patent No.: US 9,347,632 B2
(45) Date of Patent: May 24, 2016

(54) LIGHT FIXTURE

(71) Applicant: Thomas W. Adkins, Toledo, OH (US)

(72) Inventor: Thomas W. Adkins, Toledo, OH (US)

(73) Assignee: Thomas W. Adkins, Toledo, OH (US)

( * ) Notice: Subject to any disclaimer, the term of this patent is extended or adjusted under 35 U.S.C. 154(b) by 33 days.

(21) Appl. No.: 14/524,283

(22) Filed: Oct. 27, 2014

(65) Prior Publication Data

US 2015/0117025 A1 Apr. 30, 2015

Related U.S. Application Data

(60) Provisional application No. 61/896,177, filed on Oct. 28, 2013.

(51) Int. Cl.

| | |
|---|---|
| ***F21V 21/02*** | (2006.01) |
| ***F21K 99/00*** | (2010.01) |
| ***F21S 8/04*** | (2006.01) |
| ***F21V 15/01*** | (2006.01) |
| ***F21V 23/00*** | (2015.01) |
| *F21V 3/00* | (2015.01) |
| *F21V 19/04* | (2006.01) |

(52) U.S. Cl.

CPC . *F21S 8/04* (2013.01); *F21V 15/01* (2013.01); *F21V 23/002* (2013.01); *F21V 3/00* (2013.01); *F21V 19/04* (2013.01)

(58) Field of Classification Search

CPC ..... F21S 8/04; F21V 3/00; F21V 15/01; F21V 19/04; F21V 23/002

See application file for complete search history.

(56) References Cited

U.S. PATENT DOCUMENTS

| | | | | |
|---|---|---|---|---|
| 4,763,233 | A | 8/1988 | Poyer | |
| 5,585,688 | A * | 12/1996 | DeKleine | F21S 8/00 313/318.01 |
| 6,153,984 | A | 11/2000 | Fishbein et al. | |
| 6,536,924 | B2 | 3/2003 | Segretto | |
| 7,163,310 | B2 | 1/2007 | Sanborn et al. | |
| 8,118,449 | B2 | 2/2012 | Pawelko et al. | |
| 8,444,293 | B2 | 5/2013 | Adkins | |
| 2007/0115654 | A1 | 5/2007 | Ruben | |
| 2011/0198984 | A1 * | 8/2011 | Van De Ven | F21K 9/135 313/318.01 |

OTHER PUBLICATIONS

Retro-Bright:: Troffer/Lay-InLighting CFL Retrofit; Aug. 4, 2012; Retrofit Office Troffer/Lay-in Fixtures With Efficient Compact Fluorescent Light Bulbs.

* cited by examiner

*Primary Examiner* — Stephen F Husar
(74) *Attorney, Agent, or Firm* — Emch, Schaffer, Schaub & Porcello Co. LPA

(57) ABSTRACT

The lighting fixture comprises a receptacle having a first sidewall and a second sidewall disposed in opposed relationship and a first end wall and a second end wall disposed in opposed relationship. A back wall extends from the first and second sidewalls from the first and second end walls. The sidewalls, end walls and back wall define a chamber. The u-shaped channel having a base and opposed legs extends from the first end wall to the second end wall. The base of the channel extends into the chamber. At least one Edison screw type base socket is positioned on at least one leg of the channel. The Edison screw type base socket is designed to accept a screw type light producing lamp.

9 Claims, 3 Drawing Sheets

LIGHT FIXTURE

This application claims the benefit of provisional application No. 61/898,177 filed Oct. 28, 2013.

BACKGROUND OF THE INVENTION

Commercial Industrial and Residential fluorescent light fixtures, using standard tubular lamps, terminal ends, and operational ballasts, are inefficient to operate. These linear lamp fluorescent fixtures require significant trouble shooting at failure, and are costly to maintain. Fluorescent light fixtures are commonly mounted on the ceilings, or placed within suspended ceiling grids, in many commercial, residential and industrial installations. The ballast terminal ends, and wiring harness required to energize the fluorescent tubular lamps, make up a complex system, which is inefficient, difficult to trouble shoot, and prone to failure. The linear tubular lamps are difficult to align and replace within the fixture, require a great deal of storage space, and are difficult to properly dispose of. This system creates additional heat, due to its complexity, and in a fluorescent fixture with multiple linear lamps, a problem in one lamp may affect the light output of the other lamps, or the efficacy of the entire fixture. The lighting fixture of the present invention overcomes the disadvantages associated with the prior art lighting fixtures, which utilize linear fluorescent lamps, and their associated components.

SUMMARY OF THE INVENTION

The present invention is directed to a ceiling light fixture having at least one Edison screw type (ES) socket for receiving an Edison screw type base lamp. In particular, the lighting fixture has a plurality of Edison screw type (ES) sockets that are designed to utilize Edison screw type base compact fluorescent lamps (CFL) or light emitting diode lamps (LED) lamps that have a base that can be received in an Edison screw type base socket. The Edison screw type base lamps are easy to install, and replace, by simply twisting the lamps into the sockets. The failure of one of the Edison base lamps in a fixture does not impact or degrade the performance of the other Edison base lamps in the fixture.

The lighting fixture comprises a receptacle having a first sidewall and a second sidewall disposed in opposed relationship and a first end wall and a second end wall disposed in opposed relationship. A back wall extends from the first and second sidewalls from the first and second end walls. Together the sidewalls, end walls and back wall define a chamber. The back wall of the enclosed chamber has been formed to create a u-shaped channel having a base and opposed legs extends from the first end wall to the second end wall. The base of the channel extends into the chamber. At least one Edison screw type base socket is positioned on at least one leg of the channel The Edison base socket is designed to accept a screw type light producing or lamp. This socket is designed to accept a high efficiency Edison screw type lamp. This lamp may be energized by differing technologies, such as, but not limited to Compact Fluorescent Edison type screw base lamps, or Light Emitting Diode technology, Edison type screw base lamps.

The present invention is directed to a trotter style ceiling light fixture that uses one or more Edison screw type base sockets. The composition of these Edison screw type sockets may be any of several differing materials, including, but not limited to, a ceramic or plastic exterior housing, and a metal screw style socket within the housing. The Edison screw type base-sockets are designed to use a screw type lamp, which differs from the traditional linear fluorescent lamp, found in troffer style fixtures used previously. The light fixture has a central channel disposed in the fixture for receiving one or more Edison screw type sockets. An exterior cover, which can be of more than one design, is mounted on the back wall of the fixture to enclose the wiring harness. The invention provides a ceiling light fixture that is inexpensive to manufacture, utilizes high efficiency screw type lamps, operates at a cooler temperature, reduces costly troubleshooting, and is more efficient to operate and to maintain, than the previous designs of linear lamp troffer style light fixtures. Additional features and advantages of the present invention will be more readily understood by referring to the attached drawings, in connection with the following description.

DETAILED DESCRIPTION OF THE PREFERRED EMBODIMENTS

Figure 1:
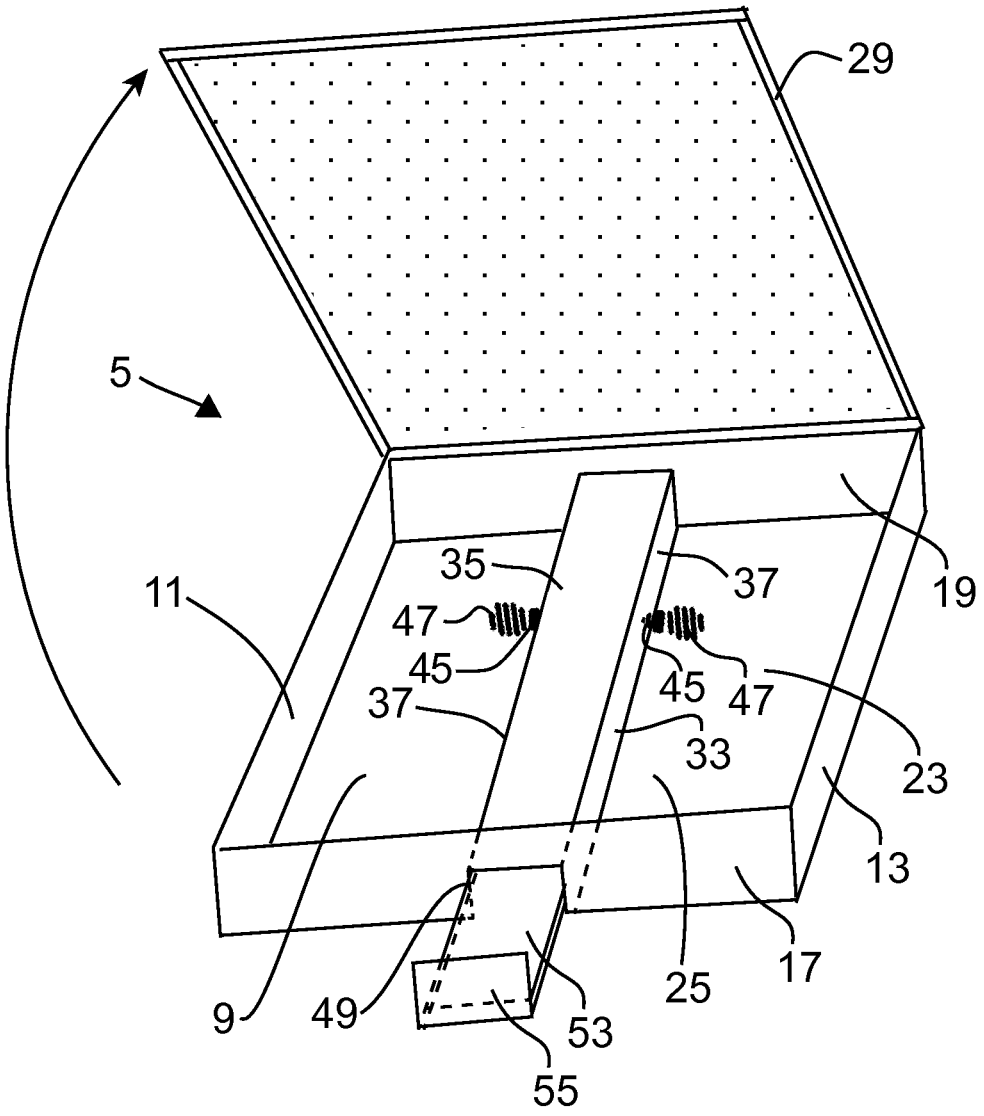
FIG. 1 is a perspective view of the light fixture of the present invention.

The invention is directed to a light fixture that uses one or more Edison base sockets that are designed to receive screw in type of lamps.

The trotter style ceiling light fixture 5 has a receptacle 9 having a first sidewall 11 and a second sidewall 13 that are disposed in opposed substantially parallel relationship. The receptacle 9 has a first end wall 17 and a second end wall 19 that are disposed and spaced apart opposed substantially parallel relationship. A back wall 23 extends from the first and second walls and from the first and second end walls to define a chamber 25 that is open on one side. A diffuser cover 29 can be pivotally attached to one of the end walls to provide a translucent closure, a transparent cover or a metal lattice style panel for the open side of the chamber 25. The diffuser cover 29 can be moved by the pivotal connection to allow access to the chamber 25 defined by the receptacle 9. When the diffuser cover 29 is positioned so that it is substantially parallel to the back wall 23 the diffuser cover essentially encloses the chamber 25.

A u-shaped channel 33 having a base 35 and opposed legs 37 extends from the first end wall 17 to the second end wall 19. The base 35 of the u-shaped channel 33 is disposed in spaced apart substantially parallel relationship with the back wall 23. The opposed legs 37 of the u-shaped channel are disposed in spaced apart substantially parallel relationship with the first sidewall 11 and the second sidewall 13. The u-shaped channel 33 defines a passageway 39 between the opposed legs 37. A passageway 39 is disposed to accommodate electrical wiring 41 utilized with a ceiling light fixture.

At least one Edison screw type base socket 45 is positioned on at least one leg 37 of the u-shaped channel 33. The at least one Edison screw type base socket is connected to the wiring 41 positioned in the passageway 39 of u-shaped channel 33. The composition of these Edison screw type sockets may be any of several differing materials, including, but not limited to, a ceramic or plastic exterior housing, and a metal screw style socket within the housing. Compact fluorescent lamps and light emitting diode lamps 47 are examples of high efficiency light sources that can be utilized with the Edison screw type base sockets. In practice it has been found desirable to have a plurality of sockets 45 positioned on the u-shaped channel 33. In most applications the Edison screw type base sockets 45 are positioned on each leg 37 of the u-shaped channel.

Figure 2:
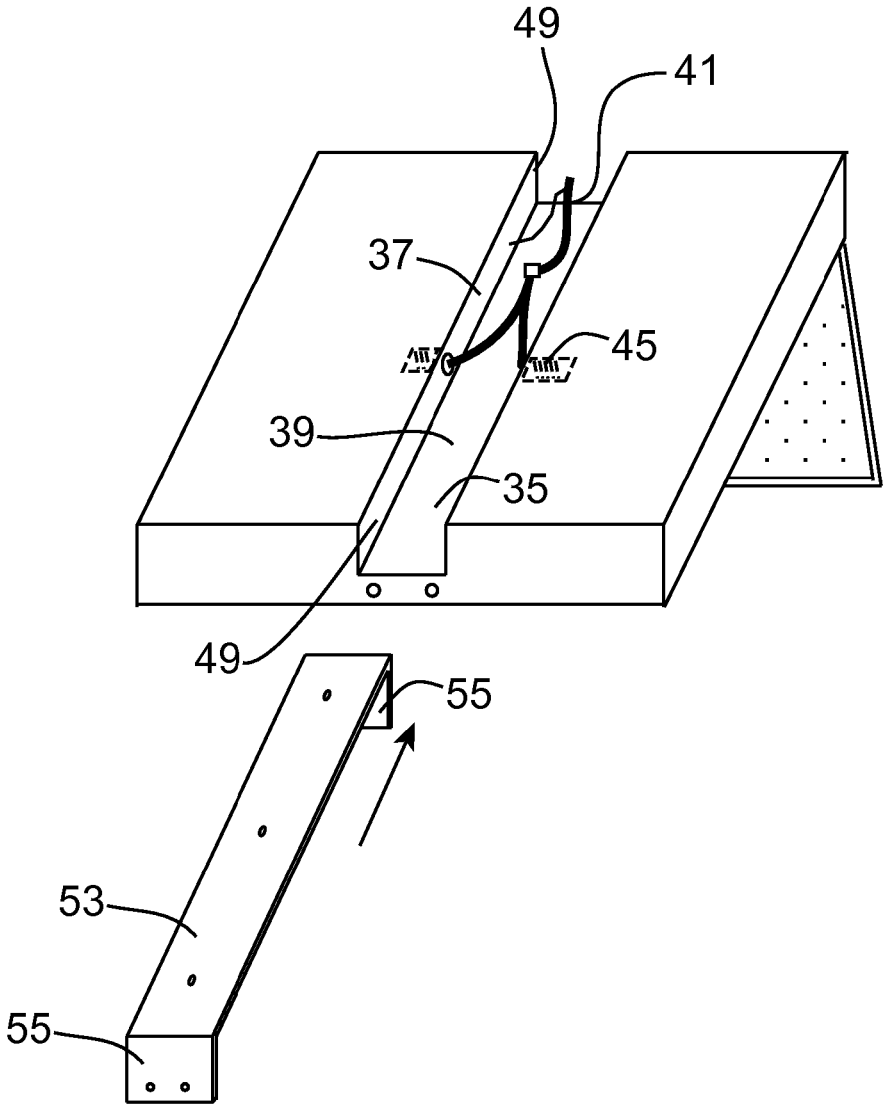
FIG. 2 is an exploded perspective view of the light fixture.

As shown in FIGS. 1 and 2 an opening 49 is positioned in the first end wall 17, and the second end wall 19 of the receptacle 9. A cover 53 is designed to be positioned on the receptacle to cover the open ends of the passageway 39 formed by the u-shaped channel 33. The cover 53 has a flange 55, positioned on each end of the cover. The two flanges are designed to extend from the cover 53 in a direction towards the base 35 of the u-shaped channel 33. The two flanges 55 are positioned substantially perpendicular to the cover 53. The flanges 55 are designed to extend over and close the openings 49 in the first and second end walls of the receptacle 8. Appropriate securing means, such as screws, can be inserted into the portions of the flanges 55 that extend over the first and second end walls to secure the cover to the receptacle 9.

Figure 3:
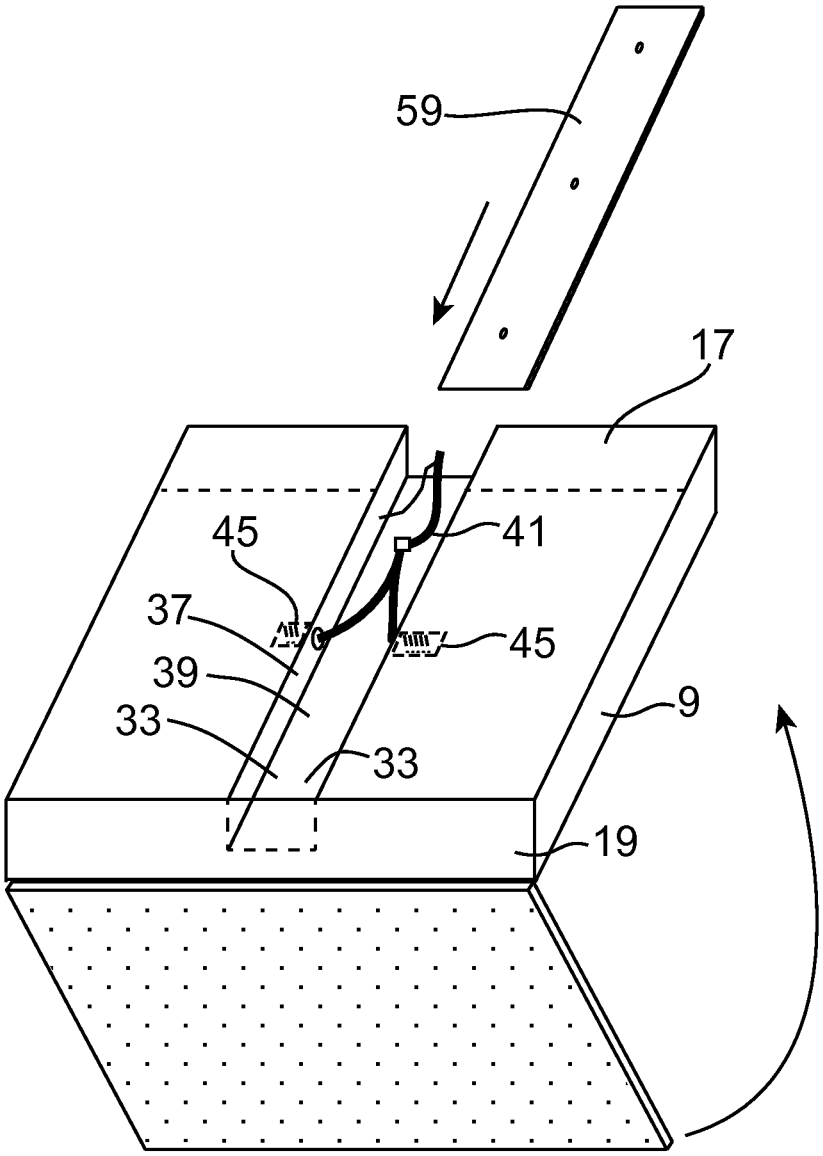
FIG. 3 is an exploded perspective view of the light fixture of the present invention.

As shown in FIG. 3 the first and second end walls, 17, 19 extend across the ends of the passageway 39 formed by the u-shaped channel 33. In this configuration a cover 59 is positioned over the open portions of the passageway 39 to enclose the passageway. Appropriate securing devices, such as screws, can be positioned in the cover 59 and extend into the back wall 23 to secure the cover 59 to the receptacle 9.

The receptacle 9 as previously disclosed is intended to be mounted on the ceiling of a room or into the grid pattern of a suspended ceiling installation. Appropriate securing means, which are well known in the art, can be used to secure the receptacle to the ceiling or the grid pattern of a suspended ceiling. Appropriate electrical wiring 41 is placed in the passageway 39 of the u-shaped channel 33 to provide electrical power to the light fixture 5. The electrical wiring 41 is secured to the Edison screw type base sockets 45, positioned on the legs 37 of the u-shaped channel 33 in a manner that is well known in the art. Once the light fixture 5 is secured to the ceiling of the building, or entered into a ceiling grid, the wiring is connected to the Edison screw type base sockets, the high efficiency Edison screw type base light lamp can be positioned in the sockets to provide illumination. The diffuser cover 29 can then be positioned over the chamber 25 to complete the installation of the light fixture. When a high efficiency light lamp has reached the end of its useful life it is a simple matter of pivoting the diffuser cover 29 to an open position to allow the used lamp to be unscrewed from the socket 45 and a new high efficiency lamp positioned in the Edison screw type base socket to complete the replacement of the light source.

The above detailed description of the present invention is given for explanatory purposes. It will be apparent to those skilled in tie art that numerous changes and modifications can be made without departing from the scope of the invention. Accordingly, the whole of the foregoing description is to be construed in an illustrative and not a limitative sense, the scope of the invention being defined solely by the appended claims.

I claim:

1. A light fixture for use in a ceiling of a building comprising:

a receptacle having a first side wall and a second side wall disposed in opposed relationship and a first end wall and a second end wall disposed in opposed relationship, a back wall extending from the first and second sidewalls and from the first and second end walls; the first and second sidewalls, the first and second end walls and the back wall defining a chamber;

a u-shaped channel having a base and opposed legs extending from the first end wall to the second end wall, the base of the channel extending into the chamber; and at least one Edison screw type base socket positioned on at least one leg of the channel, the at least one Edison screw type base socket to accept a screw type light producing element.

2. The fixture of claim 1 wherein the u-shaped channel is positioned substantially parallel to the first and second sidewalls.

3. The fixture of claim 1 wherein a plurality of sockets are positioned in the channel.

4. The fixture of claim 3 wherein the sockets are positioned on each leg of the u-shaped channel.

5. The fixture of claim 1 wherein a cover is positioned over the u-shaped channel to enclose the channel.

6. The fixture of claim 5 wherein the cover is disposed substantially parallel with the base.

7. The fixture of claim 1 wherein the first or second end walls has an opening, the u-shaped channel is designed to be inserted through the opening info the chamber.

8. The fixture of claim 7 wherein the channel has a flange on one end that closes the opening when the channel is in the desired location in the chamber.

9. The fixture of claim 6 wherein a diffuser cover is disposed on the receptacle to enclose the chamber.

* * * * *

UNITED STATES PATENT AND TRADEMARK OFFICE

CERTIFICATE OF CORRECTION

PATENT NO. : 9,347,632 B2
APPLICATION NO. : 14/524283
DATED : May 24, 2016
INVENTOR(S) : Thomas W. Adkins It is certified that error appears in the above-identified patent and that said Letters Patent is hereby corrected as shown below:

In the Claims
In column 4, line 44, please delete "6" and insert -- 8 --.

Signed and Sealed this
Nineteenth Day of July, 2016

Michelle K. Lee

Michelle K. Lee
*Director of the United States Patent and Trademark Office*